US012571203B2

(12) United States Patent
Mulcahy

(10) Patent No.: US 12,571,203 B2
(45) **Date of Patent: *Mar. 10, 2026**

(54) METHOD OF FORMING VERTICAL WALL AROUND WINDOW FRAME

(71) Applicant: Monarch Materials Group, Inc., Adel, IA (US)

(72) Inventor: David S. Mulcahy, Adel, IA (US)

(73) Assignee: Monarch Materials Group, Inc., Adel, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/527,706

(22) Filed: Dec. 4, 2023

(65) Prior Publication Data

US 2024/0102275 A1 Mar. 28, 2024

Related U.S. Application Data

(63) Continuation of application No. 17/715,182, filed on Apr. 7, 2022, now Pat. No. 11,834,823.

(60) Provisional application No. 63/171,923, filed on Apr. 7, 2021.

(51) Int. Cl.

| | |
|---|---|
| ***E04B 1/35*** | (2006.01) |
| ***E04B 1/16*** | (2006.01) |
| ***E04B 2/00*** | (2006.01) |
| ***E04C 2/04*** | (2006.01) |

(52) U.S. Cl.

CPC ..... *E04B 1/355* (2013.01); *E04B 1/16* (2013.01); *E04C 2/044* (2013.01); *E04C 2/46* (2013.01)

(58) Field of Classification Search

CPC . E04B 1/355; E04B 1/161; E04B 2/84; E04B 2/94; E04C 2/044; E04C 2/46

See application file for complete search history.

(56) References Cited

U.S. PATENT DOCUMENTS

| | | | | |
|---|---|---|---|---|
| 4,991,369 | A | 2/1991 | Lamb | |
| 7,024,821 | B2 | 4/2006 | Lu | |
| 7,051,988 | B2 | 5/2006 | Shaw | |
| 7,455,803 | B2 * | 11/2008 | Sanger | B28B 7/10 264/300 |
| 7,828,263 | B2 | 11/2010 | Bennett | |
| 8,631,628 | B1 * | 1/2014 | Beicker | E04B 1/355 52/745.2 |
| 8,677,696 | B2 | 3/2014 | Ryan | |
| 8,713,876 | B2 | 5/2014 | Kralic | |
| 10,947,746 | B2 | 3/2021 | White | |
| 2002/0145093 | A1 | 10/2002 | Shaw | |

(Continued)

OTHER PUBLICATIONS

Monarch Materials Group, Inc., "3 Current Style", 2022.
Nox-Crete, "Clean Line Reveal", 2018.

*Primary Examiner* — Gisele D Ford
(74) *Attorney, Agent, or Firm* — DENTONS DAVIS BROWN PC; Matthew Warner-Blankenship

(57) ABSTRACT

The method for pouring concrete around a window frame begins by spraying a flat surface with a release, followed by positioning window assemblies on the flat surface. The window assemblies include at least a frame, and also possibly a sash, glazing and removable bracing. The window assemblies are secured to the flat surface and then concrete is poured around the window assembly to form a wall. Once the concrete cures around the frame, the bracing is removed, and the wall is tilted/lifted to a vertical position.

17 Claims, 3 Drawing Sheets

(56) References Cited

U.S. PATENT DOCUMENTS

| | | | | |
|---|---|---|---|---|
| 2007/0145640 | A1 | 6/2007 | Jones | |
| 2009/0266014 | A1 | 10/2009 | Green | |
| 2010/0000177 | A1* | 1/2010 | Sladojevic | E04B 2/84<br>249/189 |
| 2014/0130444 | A1 | 5/2014 | Beicker | |
| 2014/0208685 | A1 | 7/2014 | Sladojevic | |
| 2015/0275555 | A1 | 10/2015 | Albrecht | |
| 2022/0009196 | A1 | 1/2022 | Klein | |

* cited by examiner

METHOD OF FORMING VERTICAL WALL AROUND WINDOW FRAME

CROSS REFERENCE TO RELATED APPLICATIONS

This application is a continuation of U.S. application Ser. No. 17/715,182, filed Apr. 7, 2022, issuing December 2023, as U.S. Pat. No. 11,834,823, which claims the benefit of U.S. Provisional Application Ser. No. 63/171,923 filed Apr. 7, 2021, the contents of each application is hereby incorporated by reference in its entirety.

BACKGROUND

Further implementations of the system can utilize an average position from all the operations performed over the course of a season or in certain implementations between seasons, as would be appreciated. Other statistical methods like the median can also be utilized, as would also be understood.

This disclosure is directed toward a method of forming a vertical wall around a window frame. More specifically, and without limitation, this disclosure relates to a method of forming a vertical tilt-up or precast wall.

Well-known in the vertical tilt-up and precast wall industry is to place boxes made of metal, plastic, wood, or the like between the wall forms and then pump the forms full of concrete capturing and surrounding the box. After the concrete cures all boxes are removed, and the wall is tilted/lifted to allow for installation of a separate window or other type of panel in the concrete opening to seal the wall from the outside environment.

When used in a tilt-up or precast construction, which is poured horizontally, a third-party glazier is required to supply a lift to reach the top of the wall, measure the concrete opening, and then fabricate the aluminum frame and glass to fit the concrete opening. Once completed, the glazier, again using a lift, installs the window in the opening. A number of problems exist with the current method. First, there is little consistency in the dimensions of concrete openings which requires the glazier to custom fit the window to the opening. Also, this process is time consuming, requiring additional labor and materials. Additionally, the process creates safety issues for the glazier. Finally, the method creates unnecessary job site waste. Accordingly, a method that addresses these deficiencies is needed.

Accordingly, an objective of the present disclosure is to provide a method of pouring a concrete wall around a complete window frame that takes less time and is safer.

Another objective of the disclosure is to provide a method of pouring concrete around a window frame that takes less labor and materials and reduces job site waste.

These and other objectives will be apparent to those having ordinary skill in the art based upon the following written description, drawings, and claims.

BRIEF SUMMARY

A method of pouring a tilt-up or precast vertical wall while in a horizontal position includes the steps of spraying a flat surface with a release and then positioning a window assembly having at least a frame, and also possibly a sash, glazing and bracing on the flat surface. Once positioned the window assembly is secured to the flat surface and concrete is poured about the window assembly to form a wall. Once the concrete cures, the bracing is removed and the wall is tilted/lifted to a vertical position.

The window assembly has a first side and a second side and the bracing is removably attached to each side. The bracing includes a first member which is configured to be removably received within the frame of the window assembly, and a second member transverse to the first member that covers the window assembly. The bracing, when secured to the flat surface, acts as a locator for the window assembly.

DETAILED DESCRIPTION

Figure 1:
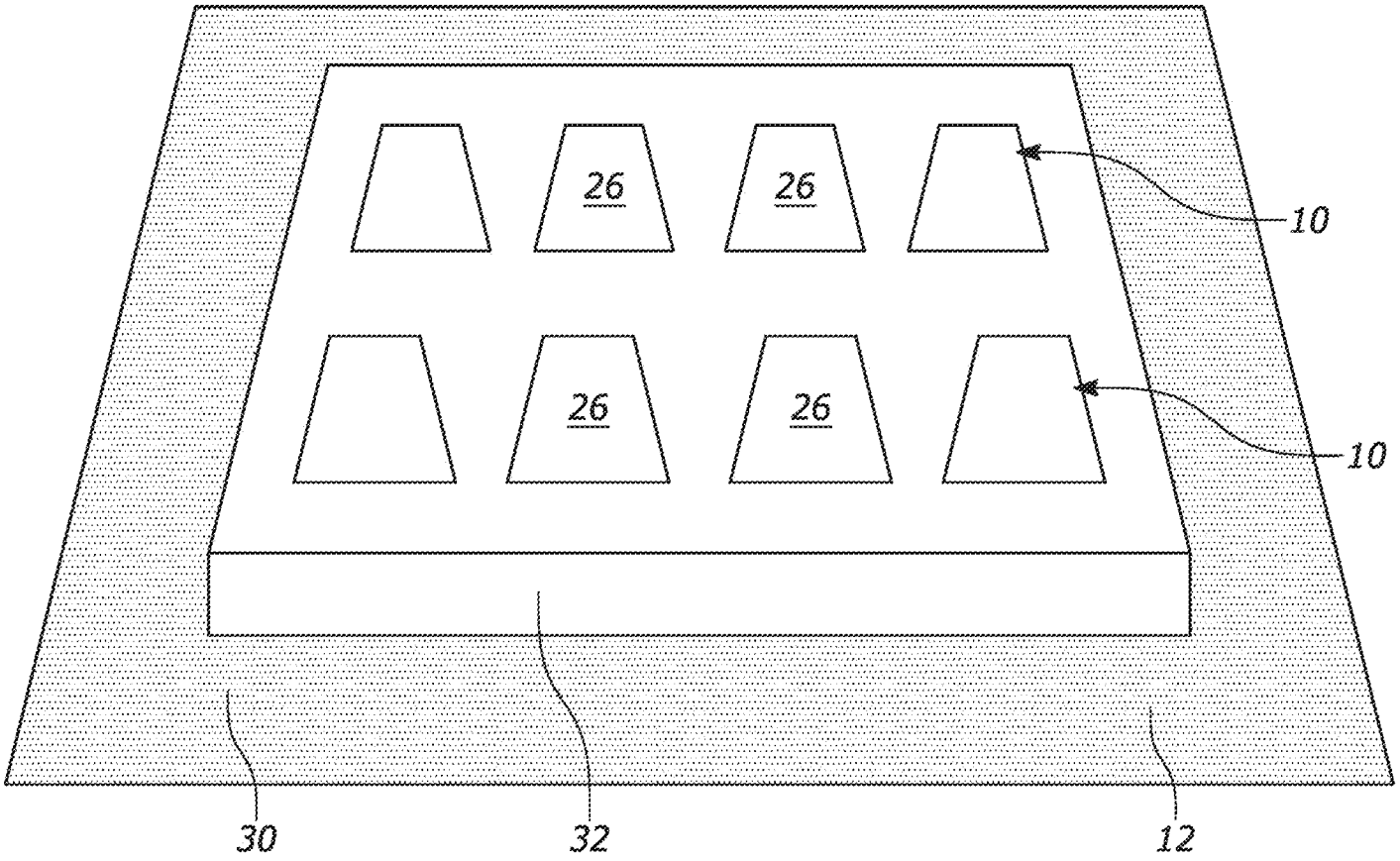
FIG. 1 is a perspective view of a plurality of window assemblies positioned on a flat surface.
Figure 2:
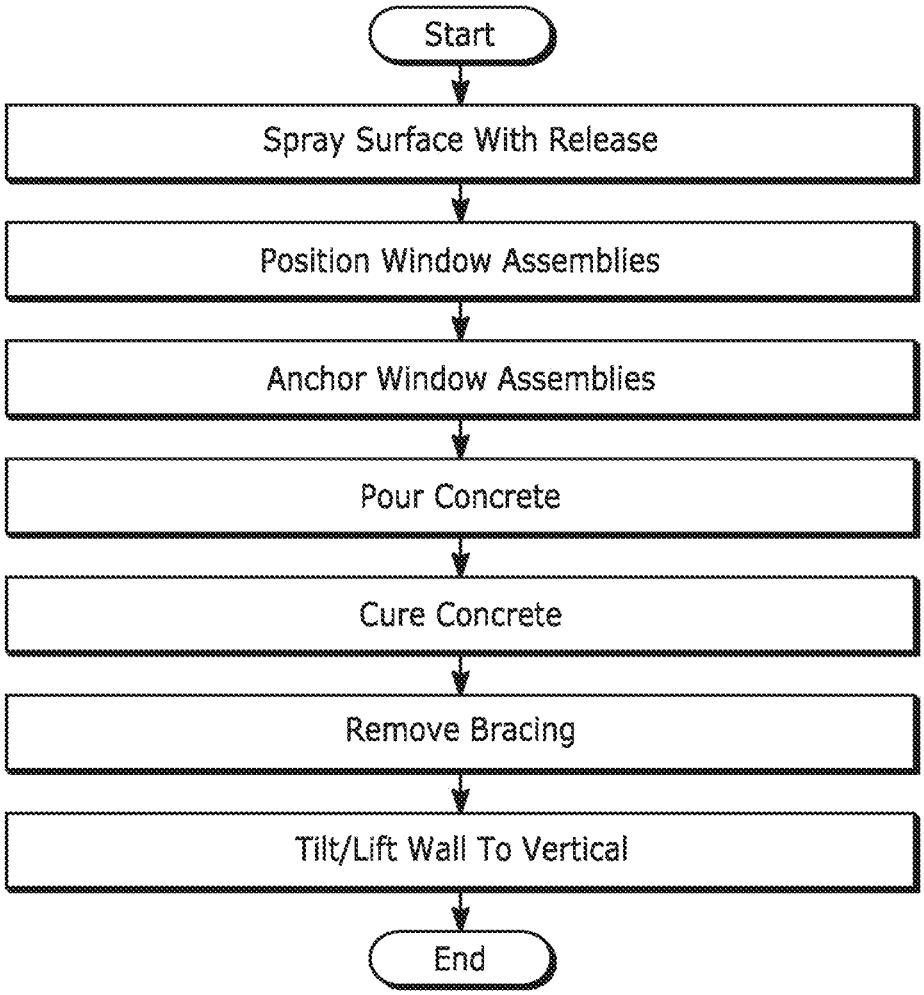
FIG. 2 is a flow diagram of a method of pouring a tilt-up vertical wall.
Figure 3:
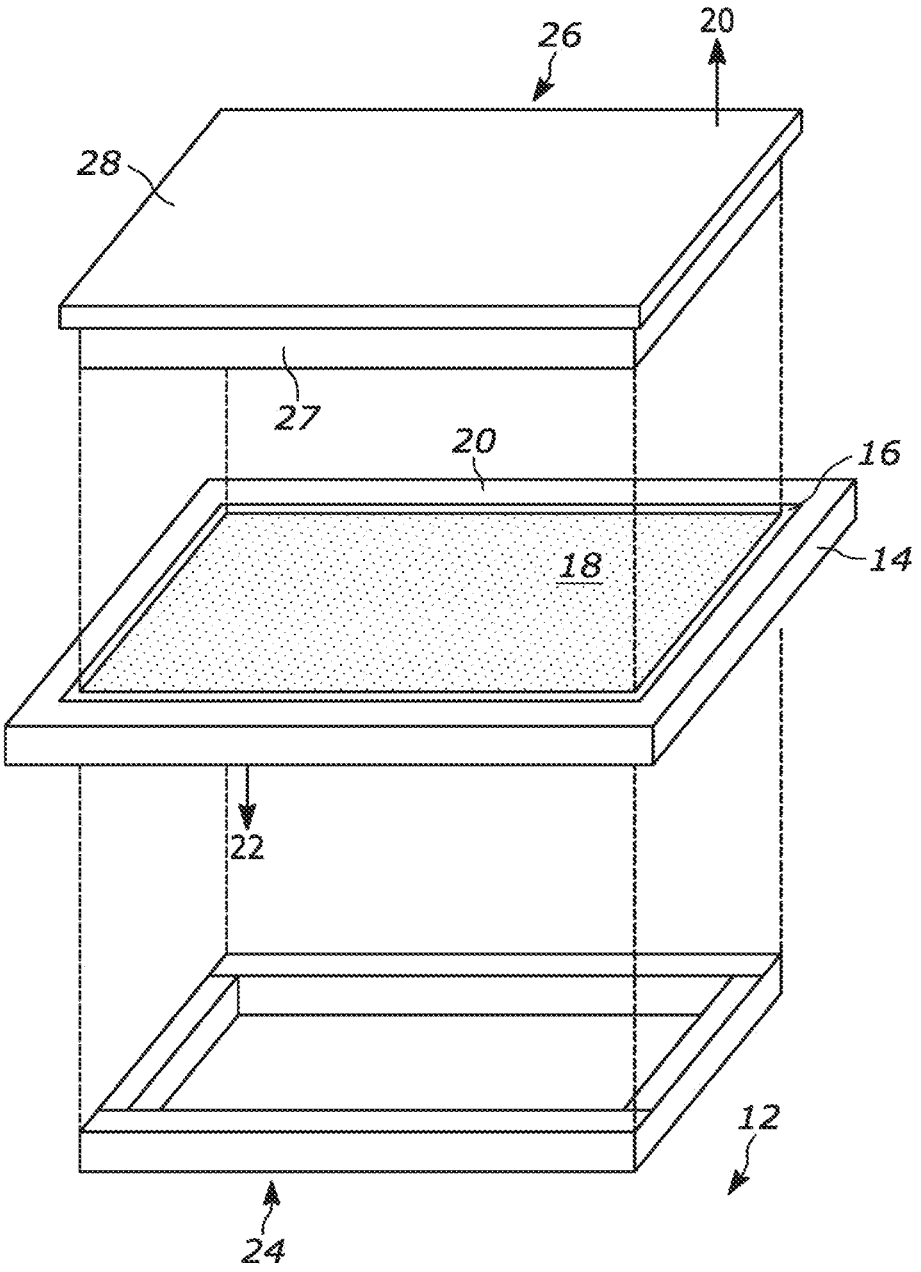
FIG. 3 is an exploded view of a window assembly.

Referring to the Figures, a method for pouring a concrete wall around a window assembly begins by positioning one or more window assemblies 10 on a flat horizontal floor or surface 12. The window assemblies 10 include at least a frame 14, but also could include a sash 16, glazing or glass 18 and first bracing 24 and second bracing 26. The window assemblies 10 have a first side 20 and a second side 22 and attached to each of the first side 20 and the second side 22, is the first bracing 24 and second bracing 26. The first bracing 24 and second bracing 26 can be of any size, shape, or structure and in the example shown in FIG. 3 has a first member 27 and a second member 28 that is transverse or perpendicular to the first member 27. The first member 27 is formed and positioned to be removably received within the frame 14 of the window assembly 10, while the second member 28 covers the first side 20 and second side 22 of the window assemblies 10.

Prior to positioning the window assemblies 10 on the floor 12 a release 30 is spayed on the floor to permit the wall 32 to be lifted from the floor without resistance. Once positioned, the window assemblies 10 are secured to the floor 12. The window assemblies 10 are secured and positioned in any conventional manner locating the first bracing 24 and/or second bracing 26 on the floor 12, such as by using double sided tape applied between the frame 14, first bracing 24, or second bracing 26 to the floor 12, by nailing the frame 14, first bracing 24, or second bracing 26 to the floor 12, or the like.

Once secured, concrete is poured about the window assemblies 10 and the concrete forms to the frame 14. After the concrete cures, if either the first bracing 24 or second bracing 26 is used, the first bracing 24 or second bracing 26 can be removed and the wall 32 can be tilted/lifted upwardly to a vertical position. The first bracing 24 and second bracing 26 can be used again. As the frames 14 have consistent measurements, there is no need to fabricate other window parts to fit the frame 14, and if the window assemblies 10 include a sash and glass, no further effort is needed to install the window assemblies 10. More specifically, no lift is needed for a glazier to be lifted to the top of the wall, potentially over uneven ground, making the process safer for the glazier. Also, there is no job site waste as the first bracing 24 and second bracing 26 can be reused, and there are no boxes that need to be disposed of. The process reduces labor and materials, and not only is more profitable, but is also safer than conventional methods.

From the above discussion, accompanying figures, and claims it will be appreciated that the wall assemblies 10 for use in pouring a tilt-up or precast walls 32 offers many advantages over the prior art. It will be appreciated further by those skilled in the art that other various modifications could be made to the device without parting from the spirit and scope of this disclosure. All such modifications and changes fall within the scope of the claims and are intended to be covered thereby. It should be understood that the examples and implementations described herein are for illustrative purposes only and that various modifications or changes in the light thereof will be suggested to persons skilled in the art and are to be included in the spirit and purview of this application.

What is claimed is:

1. A method of pouring a tilt-up vertical wall, comprising the steps of:

positioning a window assembly having a frame on a flat horizontal surface;

pouring concrete around the window assembly to form a wall and allowing the concrete to cure; and tilting the wall to a vertical position, wherein the window assembly includes a sash, bracing, and glazing.

2. The method of claim 1 further comprising securing the window assembly to the flat horizontal surface.

3. The method of claim 2 further comprising spraying the flat horizontal surface with a release.

4. The method of claim 1 wherein the bracing is removed prior to tilting the wall to a vertical position.

5. The method of claim 2 wherein the step of securing includes applying double sided tape between the frame of the window assembly and the flat surface.

6. The method of claim 2 wherein the step of securing includes nailing the frame of the window assembly to the flat surface.

7. The method of claim 2 wherein the step of securing includes securing the bracing to the flat horizontal surface.

8. The method of claim 2 wherein the window assembly has a first and a second side and the bracing is removably secured to the first and the second side.

9. The method of claim 4 wherein the bracing has a first member that removably fits within the frame of the window assembly and a second member that is transverse to the first member and covers a side of the window assembly.

10. A method of pouring a tilt-up vertical wall, comprising the steps of:

positioning a window assembly having a frame on a flat horizontal surface; and pouring concrete around the window assembly to form a wall and allowing the concrete to cure, wherein the window assembly comprises a sash, bracing, and glazing.

11. The method of claim 10 further comprising securing the window assembly to the flat horizontal surface.

12. The method of claim 11 further comprising spraying the flat horizontal surface with a release.

13. The method of claim 11 wherein the step of securing includes applying double sided tape between the frame of the window assembly and the flat surface.

14. The method of claim 11 wherein the step of securing includes nailing the frame of the window assembly to the flat surface.

15. A method of pouring a tilt-up vertical wall, comprising the steps of:

positioning a window assembly comprising a sash, glazing, bracing, and frame on a flat horizontal surface; and pouring concrete around the window assembly to form a wall and allowing the concrete to cure.

16. The method of claim 15 further comprising securing the window assembly to the flat horizontal surface.

17. The method of claim 16 further comprising spraying the flat horizontal surface with a release.

* * * * *